United States Patent [19]

Miura et al.

[11] 4,450,806

[45] May 29, 1984

[54] INTAKE AIR THROTTLE DEVICE OF A DIESEL ENGINE

[75] Inventors: Nobuhiro Miura; Kazushi Takahashi, both of Toyota, Japan

[73] Assignee: Toyota Jidosha Kabushiki Kaisha, Toyota, Japan

[21] Appl. No.: 455,736

[22] Filed: Jan. 5, 1983

[30] Foreign Application Priority Data

Jan. 18, 1982 [JP] Japan ..... 57-4837

[51] Int. Cl.[3] ..... F02D 9/00

[52] U.S. Cl. ..... 123/401; 123/376; 123/403

[58] Field of Search ..... 123/376, 378, 400, 401, 123/403, 340

[56] References Cited

U.S. PATENT DOCUMENTS 4,060,063 11/1977 Hirashawa ..... 123/376 X
4,354,464 10/1982 Fujita ..... 123/340 X
4,359,982 11/1982 Yoshioka et al. ..... 123/340 X

*Primary Examiner*—William A. Cuchlinski, Jr.
*Attorney, Agent, or Firm*—Oblon, Fisher, Spivak, McClelland & Maier

[57] ABSTRACT

An intake air throttle device, of a diesel engine, with a throttle valve disposed in an intake air passage. The throttle valve is moved into a full-open, an intermediate, and a full-closed position according to the engine operation.

An actuator for the throttle valve is vacuum-operated. A temperature sensitive valve is disposed in a conduit connecting the actuator to the vacuum source, thereby the throttle valve is brought into the full-open position when the engine is cool for preventing white smoke in exhaust gas.

5 Claims, 1 Drawing Figure

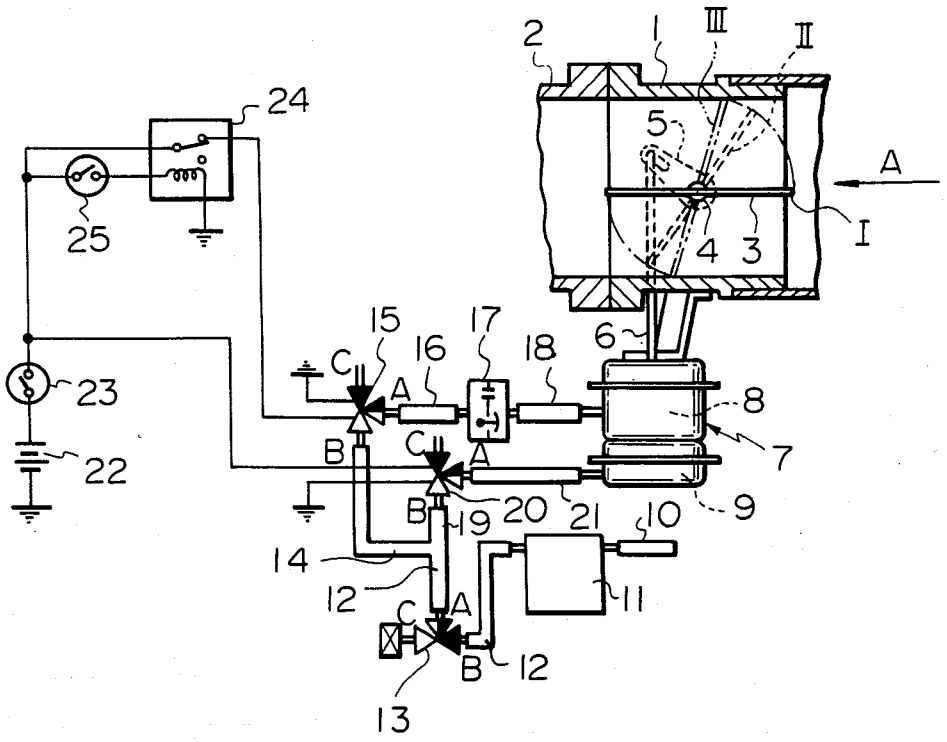
A
I
II
III
1
2
3
4
5
6
7
8
9
10
11
12
13
14
15
16
17
18
19
20
21
22
23
24
25
A
B
C

INTAKE AIR THROTTLE DEVICE OF A DIESEL ENGINE

BACKGROUND OF THE INVENTION

The present invention relates to an intake air throttle device of a diesel engine.

It is well known that a diesel engine generates considerable vibration and noise when it stops or when it runs at no load. To mitigate such vibration and noise, an intake air throttle device, which has a throttle valve disposed in an intake air passage has been proposed. This throttle valve is actuated into a half-open position to throttle the air when the engine runs at no load, i.e., engine idling or deceleration, and actuated into a full closed position to shut out the air when the engine stops. This, however, causes incomplete combustion and white smoke in exhaust gas when the air is throttled before engine warm-up, even if the fuel injection pump of the engine has a cold start fuel increasing device.

SUMMARY OF THE INVENTION

It is an object of the present invention to provide an improved intake air throttle device of a diesel engine, wherein vibration and noise can be mitigated upon engine stop or no-load running and wherein the generation of white smoke in exhaust gas is reduced upon engine idling before engine warm-up.

The present invention provides an intake air throttle device of a diesel engine, comprise a throttle valve disposed in an intake air passage; a vacuum-operated actuator for the throttle valve, the actuator being communicated with a vacuum source via a conduit means; a means for controlling the actuator so that the throttle valve is brought into a full-open position when the engine runs at a load, into a full-closed position when the engine stops, and into an intermediate position between the full-open and -closed positions when the engine runs at no load. Thus, vibration and noise upon engine stop or no-load running are mitigated. According to the invention, a temperature sensitive valve is also disposed in the conduit so that the throttle valve is brought into the full-open position when the temperature of the engine coolant is below a predetermined value. Thus, generation of white smoke in exhaust gas is also substantially reduced.

The present invention will now be described in detail in reference to an attached drawing, which illustrates a preferred embodiment of the invention.

DESCRIPTION OF THE PREFERRED EMBODIMENT

The attached drawing shows a schematical view of an intake air throttle device of a diesel engine according to the invention. Reference numeral 1 indicates an intake tube, which is connected to an intake manifold 2. The intake tube 1 and intake manifold 2 form an intake air passage to introduce air into the engine cylinder (not shown) in the direction indicated by the arrow A.

In the intake tube 1, a butterfly valve 3 is fixedly supported on a shaft 4 which can rotate with the valve 3. A lever 5 is attached to the shaft 4 at one end thereof. The other end of the lever 5 is pivotably secured to the top of a rod 6. The bottom of the rod 6 is secured to a vacuum diaphragm apparatus 7. The butterfly valve 3 can be actuated by the vacuum diaphragm apparatus 7 into a full-open position I shown by a solid line, into an intermediate position II shown by a broken line, and into a full-closed position III shown by a semibroken line.

The vacuum diaphragm apparatus 7 has a first diaphragm casing 8 and a second diaphragm casing 9 disposed in series, each casing 8 or 9 having therein a diaphragm (not shown), a spring (not shown) to bias the diaphragm in the upward direction in the drawing, and a vacuum chamber (not shown) formed by the diaphragm and a casing inner wall. The diaphragm is moved downward in the drawing due to vacuum. The bottom of the rod 6 is attached to the diaphragm of the first diaphragm casing 8. The first diaphragm casing 8 is connected to the diaphragm of the second diaphragm casing 9 so that the first diaphragm casing 8 can transmit the movement of the diaphragm of the second casing 9 to the rod 6. Thus, the butterfly valve 3 can have the full-open position I when no vacuum is supplied into the vacuum chambers of both diaphragm casings 8 and 9. The valve 3 can have the intermediate position II when the vacuum is supplied into only the vacuum chamber of the first diaphragm casing 8. The valve 3 can have the full-closed position III when the vacuum is supplied into the vacuum chambers of both diaphragm casings 8 and 9.

The vacuum is prepared in a vacuum source or a vacuum pump (not shown). The vacuum pump is connected to a vacuum tank 11 via a pipe 10. The vacuum tank 11 is connected to the first and second diaphragm casing 8 and 9 through a common pipe 12 and then through separate pipes. In this common pipe 12, a change-over valve having a bimetallic element, which is sensitive to the temperature of the engine cooling water, is disposed. From this common pipe 12, a pipe 14, a change-over valve 15 of a solenoid-operated type, a pipe 16, a one-way delay valve 17, and a pipe 18 are sequentially connected to the first diaphragm casing 8. A pipe 19, a change-over valve of a solenoid-operated type 20, and a pipe 21 are sequentially connected to the second diaphragm casing 9.

The thermostat valve 13 has three ports A, B, and C. When the temperature of the engine cooling water is below a predetermined value, the port A communicates with the port C so that atmospheric pressure is introduced into the first and second casings 8 and 9, bringing the throttle valve 3 into the full-open position I. When the temperature of the engine cooling water is above the predetermined value, the port A communicates with the port B, thus the vacuum from the vacuum tank 11 is introduced to both solenoid valves 15 and 20.

Each of the solenoid valves 15 and 20 has three ports A, B, and C. When the voltage is applied to the valves, the port A communicates with port C, whereas the port A communicates with port B when the voltage is not applied. The voltage is applied from a battery charger 22 to the valves 15 and 20 through an engine key switch 23. The voltage is directly applied to the valve 20 via the engine key switch 23. For applying the voltage to the valve 15, a switch circuit comprising a relay 24 and an accelerator switch 25 is provided in series with the engine key switch 23.

In operation, the engine key 23 is switched on for starting the engine. At this instant, the voltage is applied to the valve 20, thus atmospheric pressure is introduced into the vacuum chamber of the second diaphragm casing 9 from the ports C and A of the valve 20. This is maintained while the engine key 23 is on.

The application of voltage to the solenoid valve 15 is controlled by the accelerator switch 25. The voltage is applied to the solenoid valve 15 when the accelerator switch 25 is switched off, which means that the accelerator pedal is pressed down for acceleration or for running at a load or the accelerator pedal is moved to the same direction according to a cold-start fuel-increasing operation, if such a device is provided. On the contrary, voltage is not applied to the solenoid valve 15 when the accelerator switch 25 is switched on, which means that the accelerator pedal is free so that the engine is idling or decelerating after running at a load. This condition is referred to as "no load running".

As the voltage is not applied while the engine runs at no load, the vacuum is supplied into the vacuum chamber of the first diaphragm casing 8 through the ports A and B of the solenoid valve 15. Vacuum is not supplied into the vacuum chamber of the second diaphragm casing 9, thus the throttle valve is brought into the intermediate position II. Thus, the air flowing into the combustion chamber through the intake tube 1 is throttled to some extent. It has been discovered that the rate of throttle is advantageously 10% to 30% to mitigate vibration.

Then the accelerator pedal is pressed down, the accelerator switch 25 is switched off, and voltage is not applied to the solenoid valve 15. This causes the port A to communicate with the port C, from which atmospheric pressure is supplied into the vacuum chamber of the first diaphragm casing 8. Therefore, the throttle valve 3 is brought into the full-open position I. As the air is not throttled, the engine can run with its fundamental power. The one way delay valve 17 serves so that the throttle valve 3 can move gradually from the full-open position I to the intermediate position II upon sudden deceleration, but can move rapidly from the intermediate position II to the full-open position I.

The temperature sensitive valve 13, which is disposed in the common pipe 12 upstream of the solenoid valves 15 and 20, does not supply vacuum to the diaphragm casings 8 and 9 when the temperature of the engine cooling water is below the predetermined valve. Thus, the throttle valve 3 is brought into the full-open position I notwithstanding the voltage being applied or not being applied to the solenoid valves 15 and 20. Thus the intake air throttle during engine idling is effected only after the temperature of the engine cooling water rises up to the predetermined value. Therefore, combustion before the engine warm-up is established more completely, reducing the white smoke in the exhaust gas.

When the engine stops, the key switch 23 is switched off and the fuel supply is stopped. As the voltage is not applied to both solenoid valves 15 and 20, the port A communicates with port B, respectively. Thus, vacuum is supplied to both vacuum chambers of the diaphragm casings 8 and 9. Therefore, the throttle valve 3 is brought into the full-closed position III. As the air does not flow into the combustion chamber, the vibration, which ordinarily occurs in the engine stop operation, is effectively reduced. This is easily confirmed by experiments.

It will be apparent to those of ordinary skill in the art that various modifications and variations can be made to the above-described embodiments of the invention without departing from the scope of the appended claims and their equivalents.

We claim:

1. An intake air throttle device of a diesel engine, comprising:

a throttle valve disposed in an intake air passage;

a vacuum-operated actuator for said throttle valve, said actuator being communicate with a vacuum source via a conduit means;

a means for controlling said actuator so that said throttle valve is brought into a full-open position when the engine runs at a load, into a full-closed position when the engine stops, and into an intermediate position between said full-open and closed positions when the engine runs at no load;

wherein the improvement is that a temperature sensitive valve is disposed in said conduit means so that said throttle valve is brought into said full-open position when the temperature of the engine coolant is below a predetermined value.

2. A device according to claim 1, wherein said vacuum operated actuator comprises a series of two vacuum diaphragm apparatuses, each of said apparatuses having a vacuum chamber and a diaphragm disposed so as to move said diaphragm due to the vacuum introduced into said vacuum chamber, and that said conduit means comprises a common conduit from said vacuum source and two separate conduits connected from said common conduit to the respective vacuum chamber of said vacuum diaphragm apparatuses.

3. A device according to claim 2, wherein a solenoid valve is disposed in each of said separate conduits for selectively supplying the vacuum into each of said vacuum chambers and that said temperature sensitive valve is disposed in said common conduit.

4. A device according to claim 3, wherein said throttle valve is brought into said full-open position when the vacuum is not supplied into both said vacuum chambers of said series of vacuum diaphragm apparatuses or when the temperature of the engine coolant is below said predetermined value, into said intermediate position when the vacuum is supplied into one of said vacuum chambers of said vacuum diaphragm apparatuses, and into said full-closed position when the vacuum is supplied into both said vacuum chambers of said vacuum diaphragm apparatuses.

5. A device according to claim 4, wherein a one way delay valve is disposed between said one of the vacuum chambers and the corresponding solenoid valve.

* * * * *